US007513582B2

(12) United States Patent
Yoon et al.

(10) Patent No.: US 7,513,582 B2
(45) Date of Patent: Apr. 7, 2009

(54) SLIDE RAIL STOPPER HAVING ANTI-OPENING AND SELF-CLOSING FUNCTIONS

(76) Inventors: Sang-Won Yoon, 606, Cheongsol Apt., Eumnae-l-ri, Eumseong-eup, Eumseong-gun, Chungcheongbuk-do (KR) 369-807; Ki Soo Ok, 202-1801, Kolon, Haneulchae 2 Cha Apt., Hogye-ri, 80, Naseo-eup, Masan-si, Gyeongsangnam-do (KR) 630-787

( * ) Notice: Subject to any disclaimer, the term of this patent is extended or adjusted under 35 U.S.C. 154(b) by 0 days.

(21) Appl. No.: 11/957,596

(22) Filed: Dec. 17, 2007

(65) Prior Publication Data

US 2008/0303396 A1 Dec. 11, 2008

(30) Foreign Application Priority Data

Jun. 5, 2007 (KR) ..... 10-2007-0055009

(51) Int. Cl.
*A47B 88/04* (2006.01)

(52) U.S. Cl. ..... 312/333; 312/319.1

(58) Field of Classification Search ..... 312/330.1, 312/333, 319.1, 334.1, 334.7, 334.44, 334.46, 312/334.47, 334.8, 319.2; 384/21, 22
See application file for complete search history.

(56) References Cited

U.S. PATENT DOCUMENTS

| | | | | |
|---|---|---|---|---|
| 3,674,329 | A * | 7/1972 | Schill | 312/319.1 |
| 5,207,781 | A * | 5/1993 | Rock | 312/319.1 |
| 5,580,138 | A * | 12/1996 | Grabher | 312/319.1 |
| 7,028,370 | B2 * | 4/2006 | Hoshide et al. | 16/96 R |
| 7,040,725 | B1 * | 5/2006 | Mao-Chin | 312/334.44 |

* cited by examiner

*Primary Examiner*—James O Hansen
(74) *Attorney, Agent, or Firm*—Levine & Mandelbaum

(57) ABSTRACT

A slide rail stopper having anti-opening and self-closing functions is installed on the storage box of a daily necessity such as a washing machine, a refrigerator, a cabinet or a desk so as to enable the storage box to be smoothly opened and closed. In the slide rail stopper, a housing has an elastic member inserting recess, a hinge pin, and a fixed rail coupling hole. An elastic member, into which a coil spring is inserted, is installed in the elastic member inserting recess. A rotary member having a holder is coupled to the hinge pin at the front of the elastic member inserting recess. A bracket protrudes from one side of the fixed rail, and is inserted into the fixed rail coupling hole.

3 Claims, 3 Drawing Sheets

SLIDE RAIL STOPPER HAVING ANTI-OPENING AND SELF-CLOSING FUNCTIONS

CLAIM OF PRIORITY

This application claims the benefit of Korean Patent Application No. 10-2007-0055009 filed on Jun. 5, 2007, in the Korean Intellectual Property Office, the disclosure of which is incorporated herein by reference.

BACKGROUND OF THE INVENTION

1. Field of the Invention

The present invention relates to a slide rail stopper having anti-opening and self-closing functions, which is installed on a storage box of a daily necessity, such as a washing machine, a refrigerator, a cabinet or a desk, so as to enable the storage box to be smoothly opened and closed, and particularly, so as to enable the storage box to be automatically closed when a slide pin arrives at a holder of the stopper, and to be prevented from being spontaneously opened by self-vibration of the daily necessity, external pressure or the like after the storage box is closed.

2. Description of the Related Art

In general, a slide rail is mounted on a variety of daily necessities. More specifically, the slide rail is installed on both sides of a storage box of the daily necessity so as to enable a user to easily open or close the storage box by pushing or pulling the slide rail with the minimum force (pressure) in a horizontal direction when the storage box is opened or closed.

The storage box is designed so that these slide rails are inserted into the fixed rails on both sides of a body of the daily necessity so as to be moved forward or backward, and so that a linear bearing is mounted between the fixed rail and the slide rail.

Since the linear bearing is installed between the fixed rail and the slide rail, the storage box is smoothly opened or closed by pushing or pulling the slide rails with the minimum force when opened or closed. At this time, the storage box must be closed by pushing the slide rail with a predetermined force until it is completely closed. Further, when the slide rail is pushed with a temporal strong force, the storage box is opened in a backward direction by a repulsive force, and thus must be closed again.

Further, in the case of the daily necessity such as the washing machine that is subjected to self-vibration or impact caused by external pressure, the closed storage box is spontaneously opened due to the vibration or the impact. In the case of the refrigerator, this spontaneous opening operation of the storage box causes refrigerated and frozen foodstuffs to be deteriorated, and increases consumption of power to become uneconomical.

SUMMARY OF THE INVENTION

The present invention has been made to solve the foregoing problems with the prior art and therefore the present invention provides a slide rail stopper, in which a holder of the stopper installed on one side of a fixed rail clamps a slide pin when the slide pin is pushed to a position of the holder, a storage box is automatically closed, thereby making the closing of the storage box smooth. The slide pin is restricted by the holder of the stopper when the storage box will be spontaneously opened in a closed state by self-vibration of a body (daily necessity) on which the storage box is installed or external impact, thereby preventing the storage box from being opened, making the use of the storage box of the daily necessity convenient, and improving reliability on the quality of a product.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The present invention will now be described more fully hereinafter with reference to the accompanying drawings, in which preferred embodiments of the invention are shown.

Figure 1:
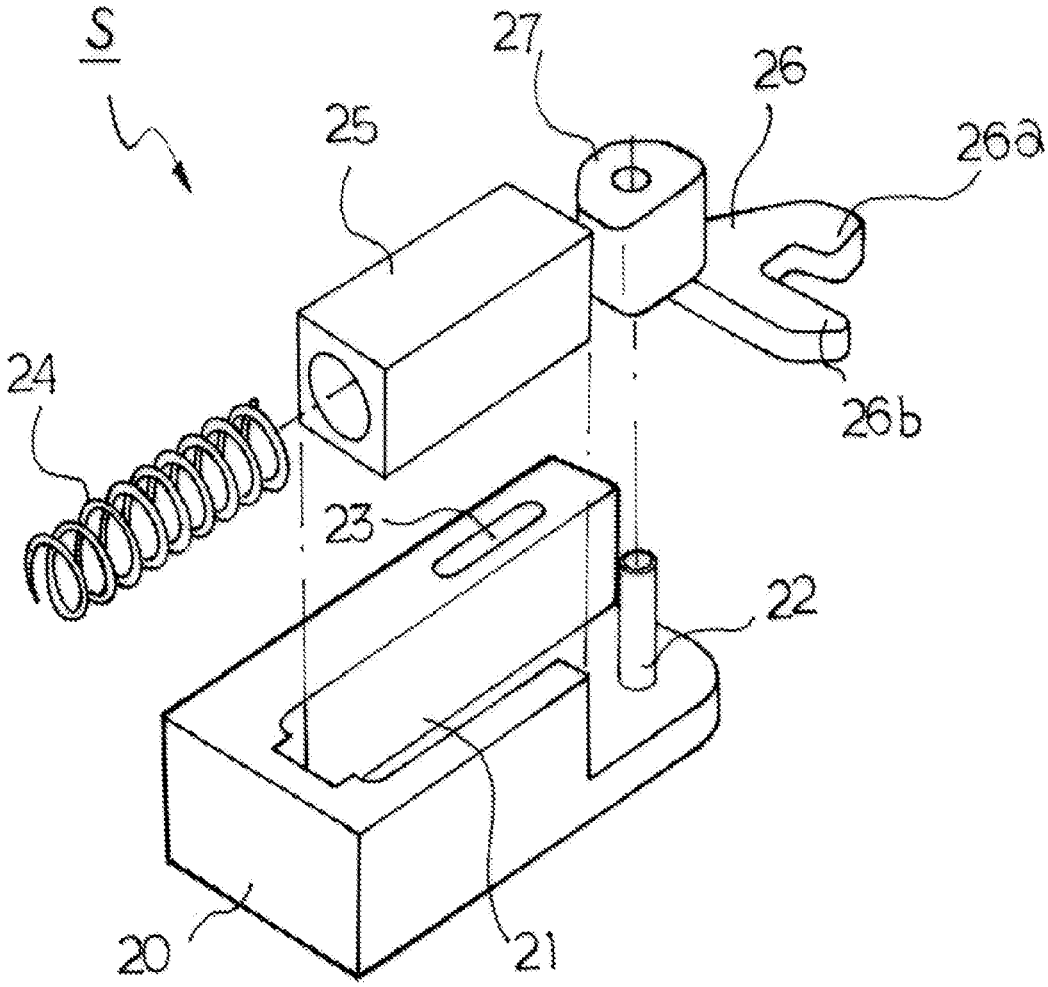
FIG. 1 is an exploded perspective view illustrating the whole structure of a stopper of the present invention.
Figure 2:
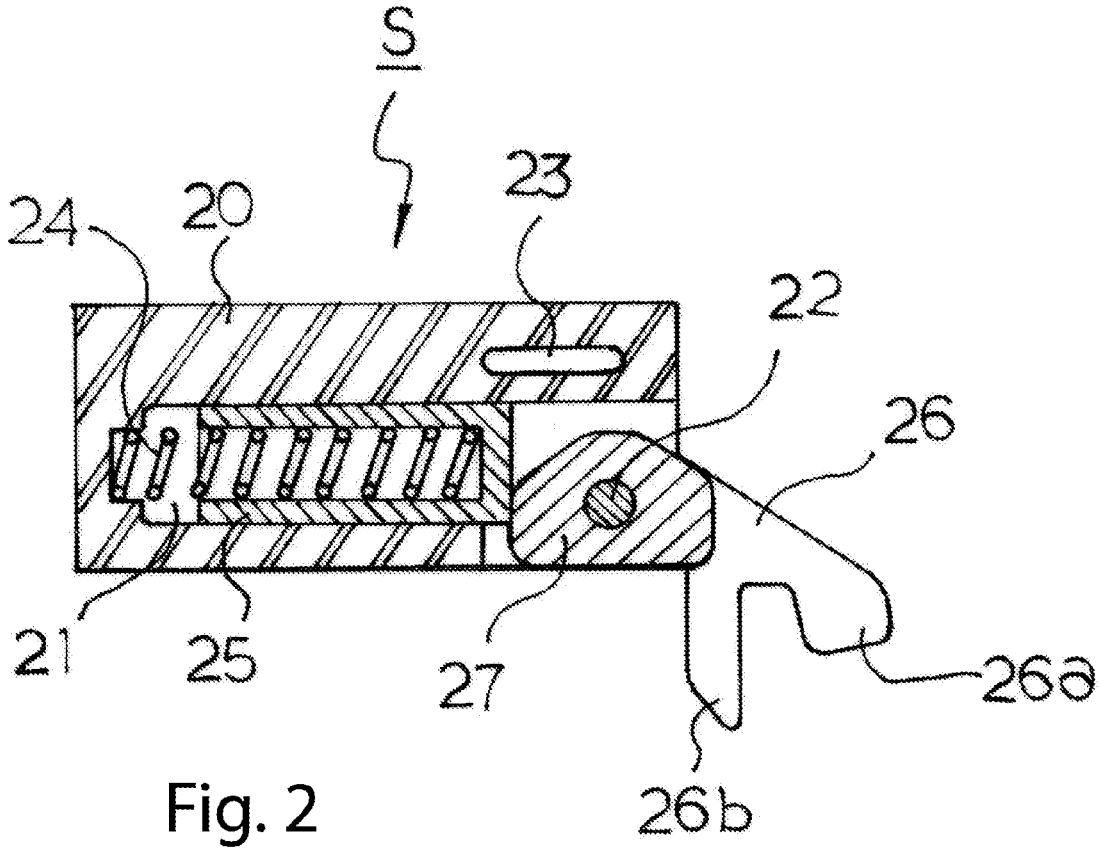
FIG. 2 is a cross-sectional view illustrating the whole structure of a stopper of the present invention.
Figure 3:
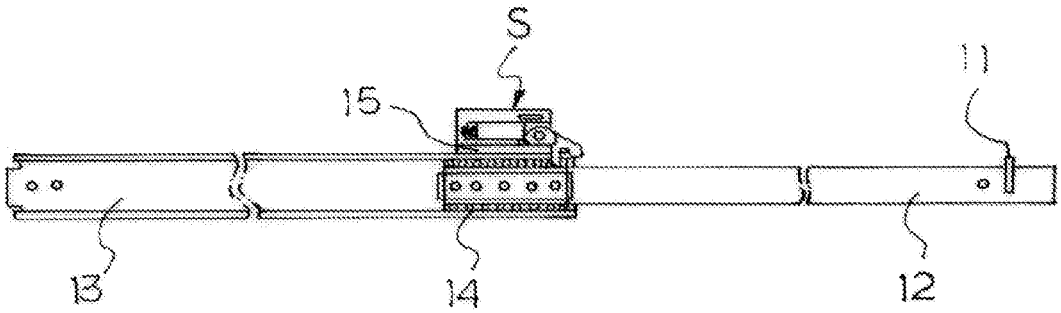
FIG. 3 is a structural view illustrating the state in which a stopper of the present invention is mounted on a slide rail.
Figure 4:
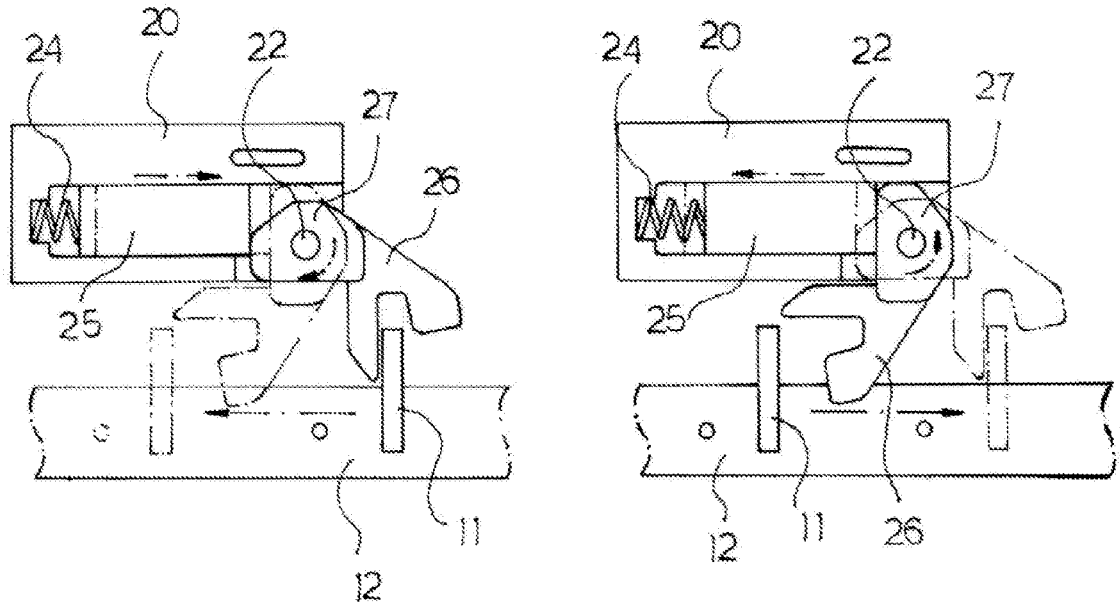
FIG. 4 is a view illustrating the operation of a stopper of the present invention.

FIGS. 1 and 2 are an exploded perspective view and a cross-sectional view illustrating the whole structure of a stopper of the present invention, in which an elastic member in which a coil spring is inserted is installed on a housing on one side of which a fixed rail coupling hole is formed, and in which a rotary member, at a front end of which a holder is formed, is coupled to a hinge pin. FIG. 3 is a structural view illustrating the state in which a stopper of the present invention is mounted on a slide rail, in which the stopper for a side rail having a fixed rail, a slide rail and a linear bearing is inserted into and coupled to a bracket that protrudes from one side of the fixed rail. FIG. 4 is a view illustrating the operation of a stopper of the present invention, in which a storage box is automatically closed when the slide pin of a slide rail is inserted into a holder of the stopper while moving in a forward or backward direction, and in which the closed storage box is not spontaneously opened because a slide pin is restricted by a holder as long as the closed storage box is not pulled with a predetermined level of force.

A stopper S is installed on a fixed rail 13 of a drawer slide in which a slide rail 12 having a slide pin 11 is inserted into and coupled to the fixed rail 13, and in which a linear bearing 14 is interposed between the slide rail 12 and the fixed rail 13.

A housing 20 is provided with an elastic member inserting recess 21, a hinge pin 22, and a fixed rail coupling hole 23. An elastic member 25, into which a coil spring 24 is inserted, is installed in the elastic member inserting recess 21. A rotary member 27 having a holder 26 is coupled to the hinge pin 22 at the front of the elastic member inserting recess 21. A bracket 15 protrudes from one side of the fixed rail 13, and is inserted into the fixed rail coupling hole 23.

The rotary member 27 is in surface contact with the elastic member 25, has rounded corners with a curvature radius, and is rotated at an angle from 90° to 120° in a clockwise or counterclockwise direction by elastic force of the elastic member 25.

The holder 26 of the rotary member 27 is adapted so that a front end 26*a* thereof is shorter than a rear end 26*b* thereof so as to automatically lock and unlock the slide pin 11.

According to the present invention, the stopper is installed on the storage box, particularly the slide rail, of a daily necessity so as to easily open and close the storage box, so that the storage box is automatically closed so long as the slide rail is moved to a predetermined position, and is prevented from being spontaneously opened by self-vibration, external pressure or external impact.

As illustrated in FIGS. 1 and 2, the housing 20 of the stopper S includes the elastic member inserting recess 21, the hinge pin 22, and the fixed rail coupling hole 23.

The elastic member 25, into an inner hollow hole of which the coil spring 24 is inserted, is placed in the elastic member inserting recess 21 of the housing 20. The rotary member 27 having the holder 26 is coupled to the hinge pin 22 at the front of the elastic member 25 so as to be in surface contact with the elastic member 25.

The rotary member 27, which is in surface contact with the elastic member 25, has the rounded corners with a predetermined curvature radius. Thus, the slide pin 11 moves to the holder 26 of the rotary member 27 when a predetermined level of force is applied thereto, and then is smoothly rotated in a clockwise direction, so that the elastic member 25 pushes the rotary member 27. Thereby, the storage box is automatically closed. In contrast, the slide pin 11 is pulled to smoothly rotate the holder 26 in a counterclockwise direction. Thereby, storage box is opened. Further, the rotary member 27 is rotated at an angle from 90° to 120° in a clockwise or counterclockwise direction by elastic force of the elastic member 25 depending on the storage box.

The front end 26*a* of the holder 26 of the rotary member 27 is adapted to be shorter than the rear end 26*b* of the holder 26 such that the slide pin 11 mounted on the slide rail 12 automatically closes and easily opens the storage box.

As in FIG. 3, the stopper S assembled as described above is installed in a manner such that the bracket 15, which protrudes from one side of the fixed rail 13, is inserted into the fixed rail coupling hole 23 formed on one side of the housing 20.

The operation of the stopper S is as follows.

The stopper S is installed on the bracket 15, which protrudes from one side of the fixed rail 13 installed on the body of the daily necessity. The slide rail 12, which is inserted into the fixed rail 13 and has the slide pin 11 moved in a forward or backward direction by the linear bearing 14, is installed on both sides of the storage box.

As shown in FIG. 4, as for the operation of closing the storage box, when the storage box is pushed in a backward direction, the slide pin 11 of the slide rail 12 is inserted into the holder 26 of the stopper S. At this time, when the slide pin 11 pushes the rear end 26*b* past the front end 26*a* of the holder 26, the elastic member 25 pushes the rotary member 27. Thereby, the storage box is automatically closed.

In other words, when the slide pin 11 pushes the rear end 26*b* of the holder 26, a small flat face of the rotary member 27, which is in surface contact with the elastic member 25, is rotated to go past the rounded corner of the rotary member 27, i.e. is rotated at an angle from 90° to 120° in a clockwise direction. A large flat face of the rotary member is pushed by the elastic member 25. At this time, the coil spring 24, from a position compressed in the hollow hole of the elastic member 25, is stretched_to move the holder 26 in a backward direction. Thereby, the storage box is automatically closed.

As for the operation of opening the storage box, when the storage box is moved forward, i.e. is pulled, the slide pin 11 of the slide rail 12 pulls the holder 26 of the stopper S, and thus the rotary member 27 pushes the elastic member 25. Thereby, the storage box is opened.

In other words, when the slide pin 11 is pulled with a predetermined level of force after being in contact with the holder 25, the holder is rotated in a counterclockwise direction, and thus the rotary member 27 is also rotated in a counterclockwise direction. At this time, the large flat face of the rotary member 27, which is in surface contact with the elastic member 25, is rotated to go past the rounded corner of the rotary member 27. When the small flat face of the rotary member pushes the elastic member 25, the coil spring 24 is compressed, and the slide pin 11 is moved in a forward direction by the rear end 26*b* of the holder 26. Thereby, the storage box is opened.

As for the anti-opening function of the storage box, in which the storage box is prevented from being opened by self-vibration, external pressure or external impact of the daily necessity, when a predetermined level of force (self-vibration, external pressure or external impact) is applied to the storage box in the state where the storage box is closed, the storage box may be opened spontaneously. In this case, the slide pin 11 of the slide rail 12 must be moved in a forward direction.

At this time, the slide pin 11 is caught by the holder 26 of the rotary member 27, and thus no longer moves in a forward direction, so that the storage box maintains a closed state.

In other words, the holder 26 must be pushed to rotate the rotary member 27 in a counterclockwise direction in order to unlock the slide pin 11.

When the rotary member 27 must be pulled with a predetermined level of force in order to rotate the rotary member 27 in a counterclockwise direction as in the opening operation of the storage box, the rotary member 27, which is in surface contact with the elastic member 25, is rotated in a counterclockwise direction. Thus, the storage box cannot be opened by the self-vibration, external pressure or external impact applied thereto.

As can be seen from the foregoing, the stopper of the present invention is additionally installed on the storage box, which is installed on the daily necessity is smoothly opened and closed by the slide rail. Thus, the storage box is automatically closed so long as the slide rail is moved to a predetermined position. Further, the closed storage box is not spontaneously opened by weak force such as self-vibration, external pressure or external impact generated from the body of the daily necessity. Thereby, the storage box can be easily arranged, improve external appearance thereof, and be conveniently and easily opened and closed.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

What is claimed is:

1. In a drawer slide assembly having a slide rail, a fixed rail, and a linear bearing interposed between the slide rail and the fixed rail for installation on a drawer, the improvement comprising:

a housing mounted on the fixed rail, said housing having an elastic member inserting recess, and a hinge pin;

a slide pin mounted on said slide rail;

an elastic member installed in the elastic member inserting recess;

a coil spring inserted into the elastic member; and a rotary member having a holder, and pivotally mounted on said hinge pin in front of the elastic member inserting recess for rotation by said slide pin in one direction when said drawer is pulled from a closed position toward an open position and for rotation by said slide pin in an opposite direction as said drawer approaches said closed position;

wherein said elastic member causing said rotary member to clamp said slide pin as said drawer nears its closed position for urging said drawer into said closed position and for resisting opening of said drawer from said closed position.

2. The drawer slide assembly according to claim 1, wherein the rotary member is in surface contact with the elastic member, has rounded corners with a curvature radius, and is rotated at an angle from 90° to 120° in a clockwise or counterclockwise direction by elastic force of the elastic member.

3. The drawer slide assembly according to claim 1, wherein the holder of the rotary member has a front end thereof that is shorter than a rear end thereof such that the slide pin automatically closes and opens said drawer.

* * * * *